US010759161B2

(12) United States Patent
Todie

(10) Patent No.: US 10,759,161 B2
(45) Date of Patent: Sep. 1, 2020

(54) METHOD FOR CREATING DESIGNS AND RAISED PATTERNS ON THE FOLDS, RECESSED PORTIONS, AND EDGE SURFACES OF OBJECTS CONSISTING OF SHEETS

(71) Applicant: Cristian Todie, Paris (FR)

(72) Inventor: Cristian Todie, Paris (FR)

( * ) Notice: Subject to any disclaimer, the term of this patent is extended or adjusted under 35 U.S.C. 154(b) by 889 days.

(21) Appl. No.: 14/379,800

(22) PCT Filed: Feb. 19, 2013

(86) PCT No.: PCT/FR2013/000045
§ 371 (c)(1),
(2) Date: Aug. 20, 2014

(87) PCT Pub. No.: WO2013/124550
PCT Pub. Date: Aug. 29, 2013

(65) Prior Publication Data

US 2015/0047524 A1 Feb. 19, 2015

(30) Foreign Application Priority Data

Feb. 21, 2012 (FR) ..... 12 00500

(51) Int. Cl.
*B41F 17/02* (2006.01)
*B42D 15/00* (2006.01)
(Continued)

(52) U.S. Cl.
CPC ..... *B41F 17/02* (2013.01); *B42D 1/006* (2013.01); *B42D 15/008* (2013.01); *B42D 1/009* (2013.01); *B44C 5/00* (2013.01)

(58) Field of Classification Search
CPC ..... B41F 17/02; B42D 1/006; B42D 15/008; B42D 1/009; B44C 5/00
(Continued)

(56) References Cited

U.S. PATENT DOCUMENTS 512,882 A * 1/1894 Hillhouse ..... B42D 1/006 283/34
660,637 A * 10/1900 Herrmann ..... B41F 1/38 101/368
(Continued)

FOREIGN PATENT DOCUMENTS

BE 352609 A 12/1928
FR 2805205 A1 8/2001
(Continued)

*Primary Examiner* — Sameh Tawfik
(74) *Attorney, Agent, or Firm* — Rita C. Chipperson; Chipperson Law Group, P.C.

(57) ABSTRACT

The present invention relates to the bulk manufacture of objects, materials, or products from sheets or fabrics, which are either folded or to be folded, with designs, images, text, and raised patterns that are reconstituted strip by strip at the edge of the folds thereof, in the recessed portions, and in the edge surfaces. The present invention provides a process for repeating designs and shapes, which are shifted relative to one another, on at least one sheet and from one sheet to the other, by reproducing, cutting, or stamping, is merged with folding operations necessitated by the design or suitable for the technical process of the machines in a predetermined manufacturing procedure.

7 Claims, 7 Drawing Sheets

(51) Int. Cl.
*B42D 1/00* (2006.01)
*B44C 5/00* (2006.01)

(58) Field of Classification Search
USPC ..... 493/324
See application file for complete search history.

(56) References Cited

U.S. PATENT DOCUMENTS 1,271,091 A * 7/1918 Sito ..... F21V 1/06 362/352
D74,398 S * 2/1928 Stivale ..... D26/118
1,787,276 A * 12/1930 Jones ..... B42D 1/006 281/15.1
2,668,385 A * 2/1954 Pettorossi ..... A47G 33/08 428/9
2,922,239 A * 1/1960 Glynn, Jr. ..... A41G 1/04 428/9
2,927,383 A * 3/1960 Longino ..... G09B 27/02 434/140
3,414,296 A * 12/1968 Schneider ..... B42D 1/006 156/250
3,518,785 A * 7/1970 Behr ..... A63H 3/08 273/155
3,713,673 A * 1/1973 Katz ..... B42F 5/00 229/68.1
3,788,934 A * 1/1974 Coppa ..... A63H 33/16 428/12
3,792,982 A * 2/1974 David ..... B21D 11/00 270/32
3,820,447 A * 6/1974 Gendron et al. ..... B31B 19/00 101/93.07
3,899,381 A * 8/1975 O'Brien ..... B42C 3/00 156/181
4,066,251 A * 1/1978 Johnsen ..... B65H 39/16 270/37
4,227,334 A * 10/1980 Hooker ..... A63H 33/16 428/542.8
4,319,941 A * 3/1982 Brownell ..... A63H 33/16 156/204
4,524,993 A * 6/1985 Walker-Taylor ..... A63H 33/38 281/15.1
4,685,699 A * 8/1987 Hirasawa ..... B42D 7/00 281/15.1
D314,835 S * 2/1991 Ebihara ..... D26/118
5,024,012 A * 6/1991 Lovik ..... G09F 1/06 40/212
5,036,635 A * 8/1991 Lalvani ..... A63H 33/04 52/80.1
5,234,727 A * 8/1993 Hoberman ..... A63H 33/16 428/12
5,301,036 A * 4/1994 Barrett ..... H04N 1/3877 345/656
5,393,579 A * 2/1995 Witte ..... A47G 33/08 428/11
5,484,378 A * 1/1996 Braithwaite ..... B31D 5/02 493/356
5,492,584 A * 2/1996 Bateman ..... B31D 5/04 156/197
5,530,517 A * 6/1996 Patton ..... G03B 31/06 235/462.05
5,678,822 A * 10/1997 Setteducati ..... A63F 1/02 273/296
5,759,328 A * 6/1998 Richwine ..... B42D 15/00 156/227
5,938,727 A * 8/1999 Ikeda ..... G06F 17/30879 707/E17.113
6,022,260 A * 2/2000 Fritzel ..... A63H 27/001 446/488
6,273,471 B1 * 8/2001 Zanardi ..... B42D 1/006 281/2
6,523,826 B1 * 2/2003 Matos ..... A63F 9/0613 273/155
6,994,052 B1 * 2/2006 McMullen ..... B42D 9/008 116/234
8,054,480 B2 * 11/2011 Mizobuchi ..... G03G 15/607 358/1.1
9,683,714 B1 * 6/2017 Gunawan ..... F21V 3/049
2003/0107164 A1 * 6/2003 Todie ..... B41M 3/00 270/5.02
2005/0200115 A1 * 9/2005 Tsubouchi ..... B42D 1/006 281/15.1
2013/0260091 A1 * 10/2013 Stein ..... B42D 1/004 428/131

FOREIGN PATENT DOCUMENTS

FR 2812558 A3 8/2002
JP H0210077 U 1/1990
JP 2000135880 A 5/2000

* cited by examiner

Plate
1
1+x
b
a
y
CUT
c d
e
f zig-zag folds
wound folds
parallel folds
g

A
B
C
D
h

Plate

Plate

Plate
a
b
CUT
c d
e
f
g h
i
j k
l
Guillotining

METHOD FOR CREATING DESIGNS AND RAISED PATTERNS ON THE FOLDS, RECESSED PORTIONS, AND EDGE SURFACES OF OBJECTS CONSISTING OF SHEETS

CROSS-REFERENCE TO RELATED APPLICATIONS

This application claims the benefit of and is a national phase filing of the PCT patent application entitled "Method For Creating Designs and Raised Patterns On The Folds, Recessed Portions, and Edge Surfaces Of Objects Consisting of Sheets" having International Application No. PCT/FR2013/000045, filed Feb. 19, 2013, which claims the benefit of the French patent application having application no. 1200500, filed Feb. 21, 2012, both of which are hereby incorporated by reference in their entirety as if fully set forth herein.

BACKGROUND OF THE INVENTION

Field of the Invention

The present invention relates to the manufacturing of objects, materials or products in volume from sheets or fabrics, folded or intended to be folded, with designs, images, texts and raised patterns, reconstituted strip by strip, at the edge of their folds, in the recessed parts and in the edge surfaces.

The method applies mainly to the publishing of books and to stationery, for example: brochures, notebooks, sketchbooks, notepads, diaries and catalogs. It may also lend itself to the innovation of novel forms of books and notebooks in bulk, for example cylindrical (FIG. 2*f*) or triangular prism (FIG. 6*d*,) or with low reliefs on the edge surface (FIG. 11*g*), and also to objects, games, toys, jewelry, as well as to fashion accessories, decorative objects, promotional stands, packaging, furniture, and to various novel textile materials and panels made of various materials.

Description of the Relevant Art

Currently, decorative objects made of cellular paper, also called honeycomb paper, for example decorative garlands or other objects (Asian) which are made of joined colored papers just like objects deriving from the French patent of invention No. 86383737. In the manufacturing of paper objects, the folding operations are these days limited quite simply to the joining of sheets for technical or practical reasons.

BRIEF SUMMARY OF THE INVENTION

The novelty of the present invention lies in the merging of a process of repeating designs and shapes, which are shifted relative to one another, on at least one sheet and from one sheet to another, by reproduction, cutting or stamping, with folding operations dictated by the design or suited to the technical process of the machines in a determined manufacturing procedure.

BRIEF DESCRIPTION OF THE SEVERAL VIEWS OF THE DRAWINGS

Embodiments of the invention will now be described with reference to the accompanying drawings in which:

FIGS. 16*a-c* is an exemplary embodiment of the present invention;

FIGS. 17*d-g* is an exemplary embodiment of the present invention;

FIGS. 18*h-j* is an exemplary embodiment of the present invention;

DETAILED DESCRIPTION OF THE INVENTION

Figure 24:
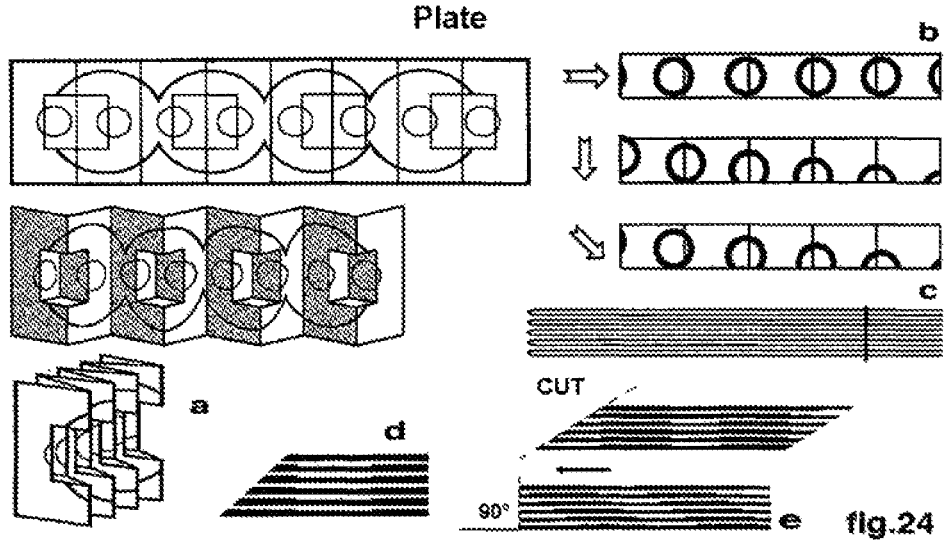
FIGS. 24*a-e* is an exemplary embodiment of the present invention.
Figure 25:
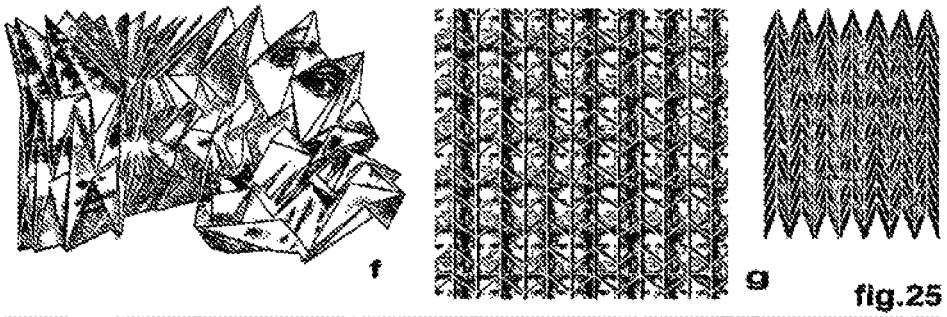
FIGS. 25*f-g* is an exemplary embodiment of the present invention.
Figure 26:
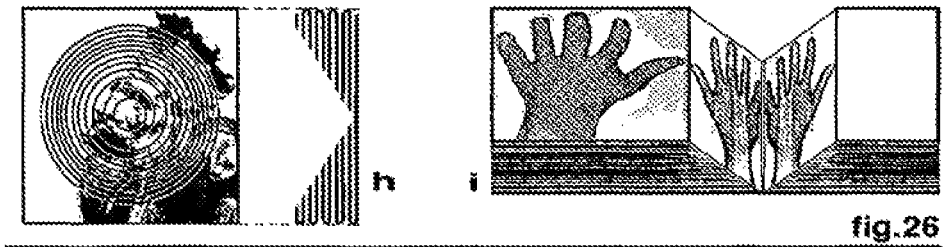
FIGS. 26*h-i* is an exemplary embodiment of the present invention.

The shifting of the patterns can be produced, for example, in a horizontal or vertical or diagonal (FIG. 24*b*) direction, depending on whether the designs are to be shown on the folds and in the lateral edge surfaces, or on the bottom and top edge surfaces. The repetition of the patterns can be produced in a single direction (FIG. 1) for simple folding operations (FIG. 3), or in several directions (FIG. 25*g*), for complex folding operations (FIG. 25).

Figure 9:
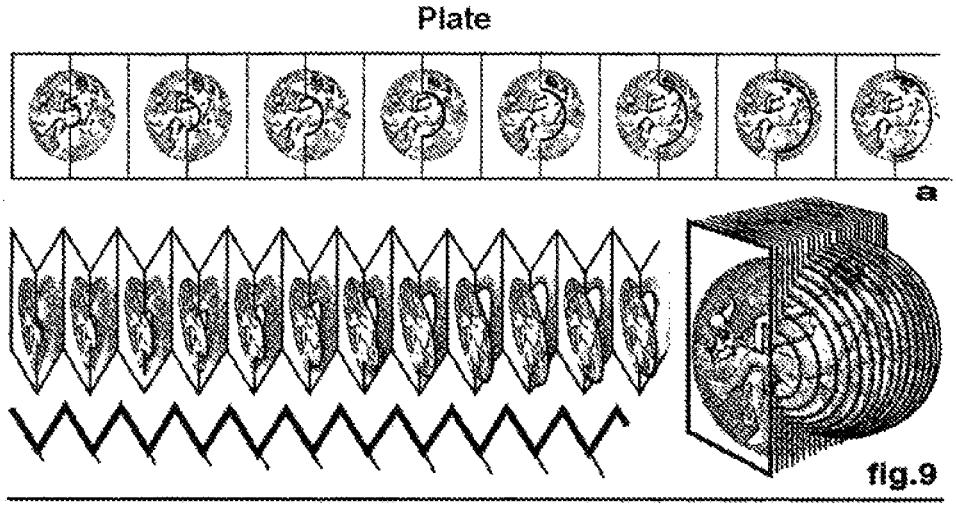
FIG. 9*a* is an exemplary embodiment of the present invention.
Figure 11:
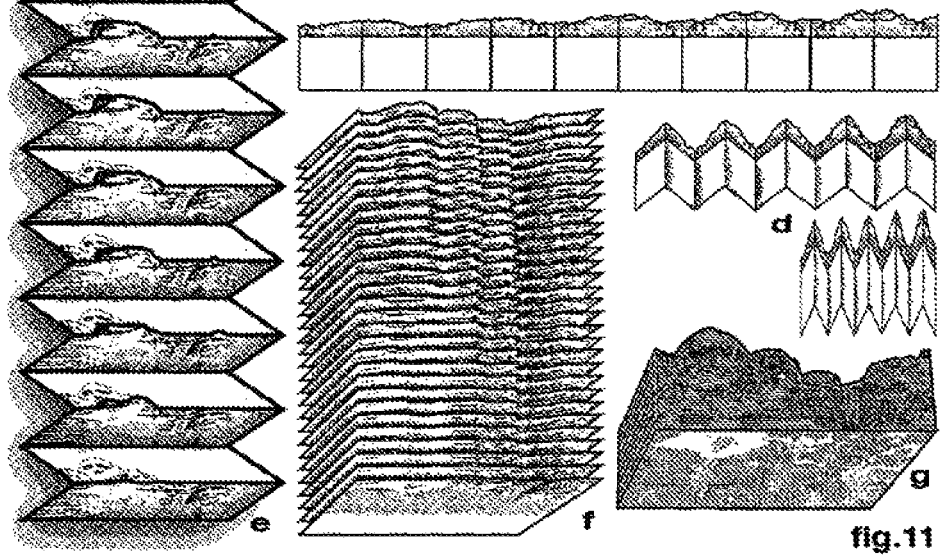
FIGS. 11*d-g* is an exemplary embodiment of the present invention.
Figure 21:
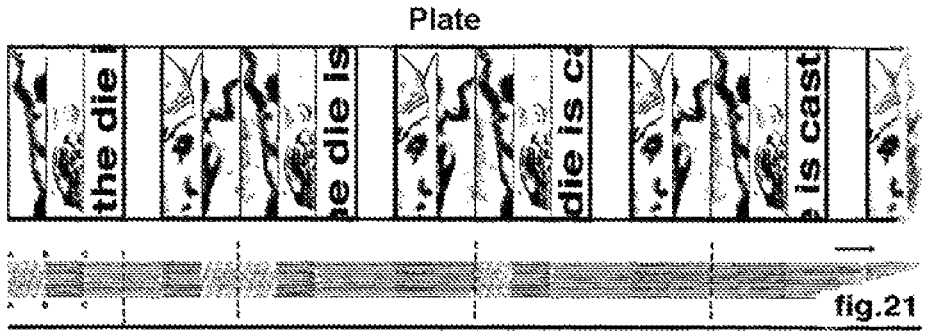
FIG. 21 is an exemplary embodiment of the present invention.
Figure 22:
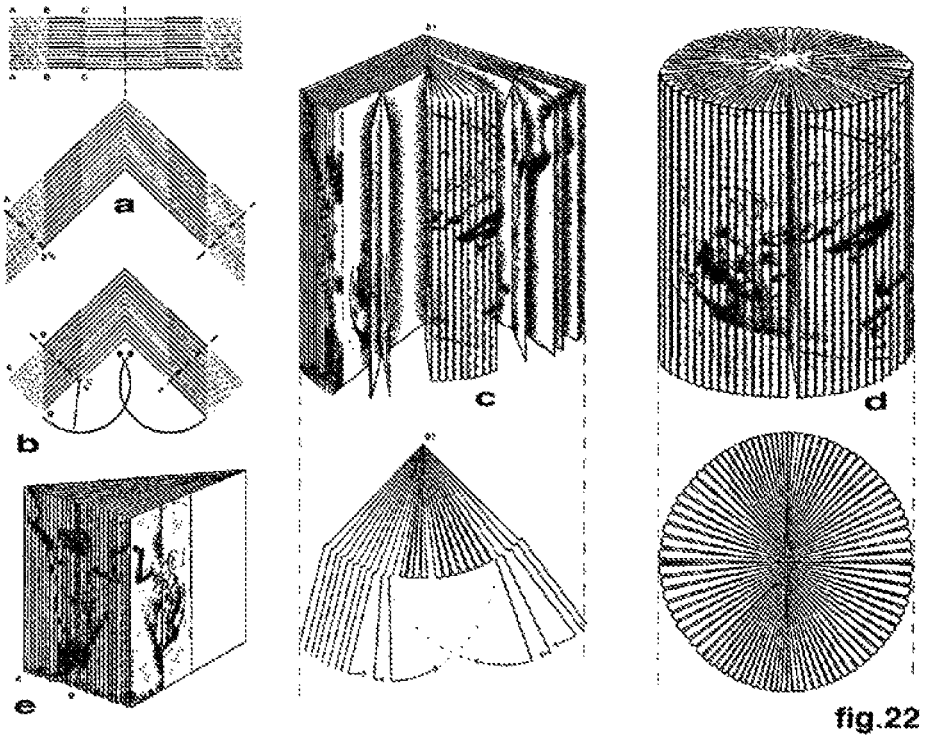
FIGS. 22*a-e* is an exemplary embodiment of the present invention.

The designs can be made up of one or more elements, for example texts, images and cutout shapes, and can be reproduced identically or its components can change relative to one another, for example a text is shifted from one design to another relative to the artwork which remains identical (FIG. 21), or an image which is reproduced identically is accompanied by cutout shapes which change, in a coherent relationship, such as, for example, topometric lines of a geometrical volume (FIG. 9*a*) or figurative volume (FIG. 11*e*). For folds for example of mixed harmonica type, the designs can comprise a number of elements each intended to appear on different folds (FIG. 24*a*). Depending on the design of the object, certain parts of the designs will be intended to appear, in the context of the same product, for example one in the edge surface of the sheets (FIG. 22*e*), and another at the folds (FIG. 22*d*). In the preparation of the designs, depending on the parameters of the procedure decided upon, certain images can be distorted or deconstructed. The repetition of the patterns can also be replaced, for example in the case of zig-zag folds, by the anamorphosis of the design on the length of the sheet. The designs used can also be related to one another, such as, for example, the sequences of a deconstructed motion (film, animation). For the wound fold (FIG. 14), a particular topometry may be used which consists in sampling the spiral dimensioning of a raised pattern followed by the corresponding linear cutting, on the edge of a sheet, which, once folded (wound), restores the original raised pattern.

Figure 10:
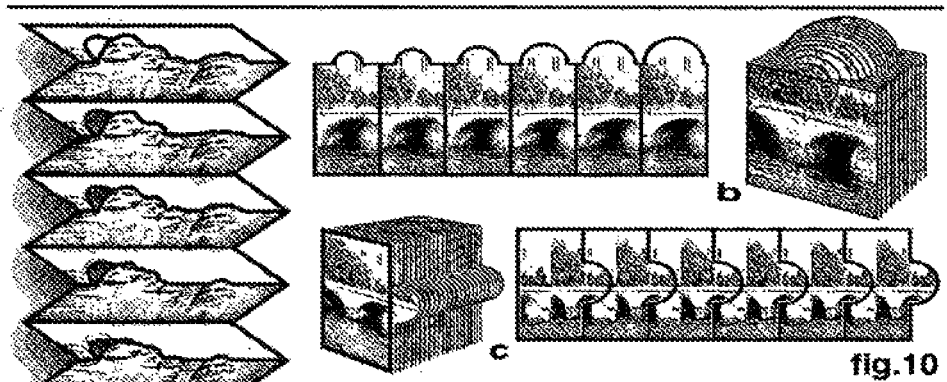
FIGS. 10*b-c* is an exemplary embodiment of the present invention.

The cutting form can be associated with a scoring operation at the point of the fold (FIGS. 9 and 11*e*) or on the edge of the sheets (FIG. 10*b*, 11*d*), repetitively with the same form (FIG. 10*c*) or with different (e.g. topometric) and progressive forms on each sheet (FIG. 11*d*) or from one sheet to another (FIG. 110. At the edge of the objects, produced from a single sheet or from a block of sheets, the volume from which the topometric samplings originate is restored to the appearance of a geometrical (FIG. 9), figurative (FIG. 11*g*) or any other low relief.

The reproductions can be performed recto or recto-verso, by any methods, for example offset, typo screen printing, decalcomania, embossing, photo reproduction, digital, hologram, lenticular.

Figure 6:
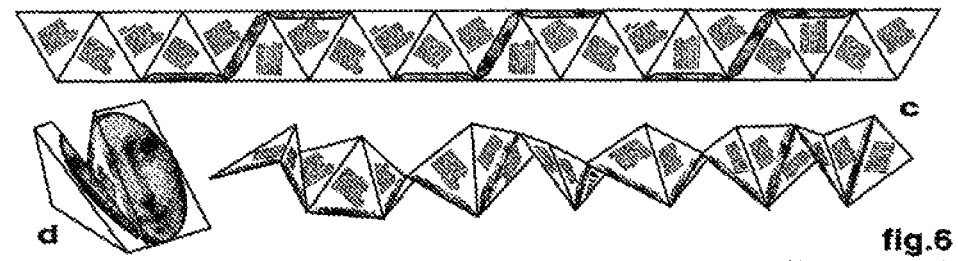
FIGS. 6*c-d* is an exemplary embodiment of the present invention.
Figure 7:
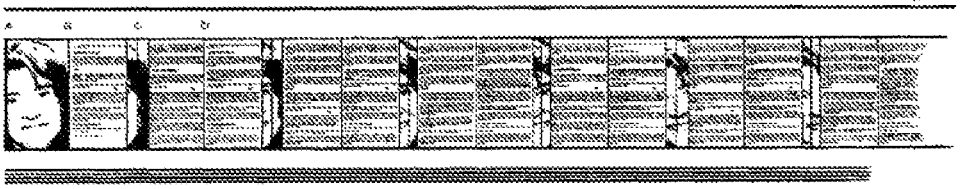
FIG. 7 is an exemplary embodiment of the present invention.
Figure 7:
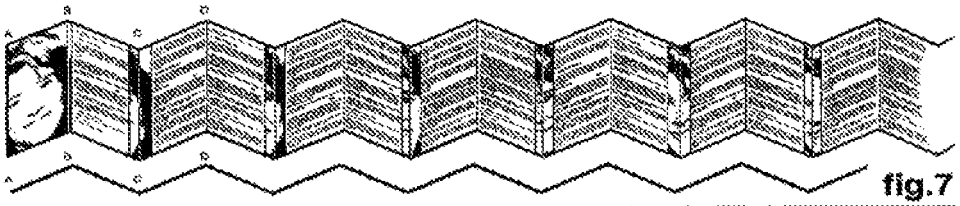

Reducing the surface areas occupied by the design in the strips corresponding to the folding or trimming point frees up the interior of the sheets to be able to accommodate the elements necessary to the design of the object for which the application is intended (FIGS. 6 and 7), or quite simply to the planned use, for example writing (e.g. notebook).

The shifting of the designs from one sheet to another can be designed at the page formatting stage, or can be performed by offsetting the sheets at the time of reproduction at the jogging level in the conventional printing machines, or obtained by an operation of folding of the volume of the sheets (FIG. 22*a*), the degree of offset being related to the thickness of the paper, or also by an operation of cutting of the blocks of sheets slantwise and a rearrangement of the block of sheets at an angle of 90° (FIG. 24*e*).

The folding operation or operations (for example crossed, parallel, mixed, zig-zag, wound folds) (FIG. 3*g*) can be applied to a volume of sheets at the same time or sheet by sheet, in the same direction, harmonica-fashion or random, performed in folding machines or manually possibly accompanied by scoring operations. The scorings can be of various sizes and forms, double or multiple, in order to give more thickness to the edge surface, parallel to one another or not according to the designs of the objects.

Figures 1, 2, 3, 4:
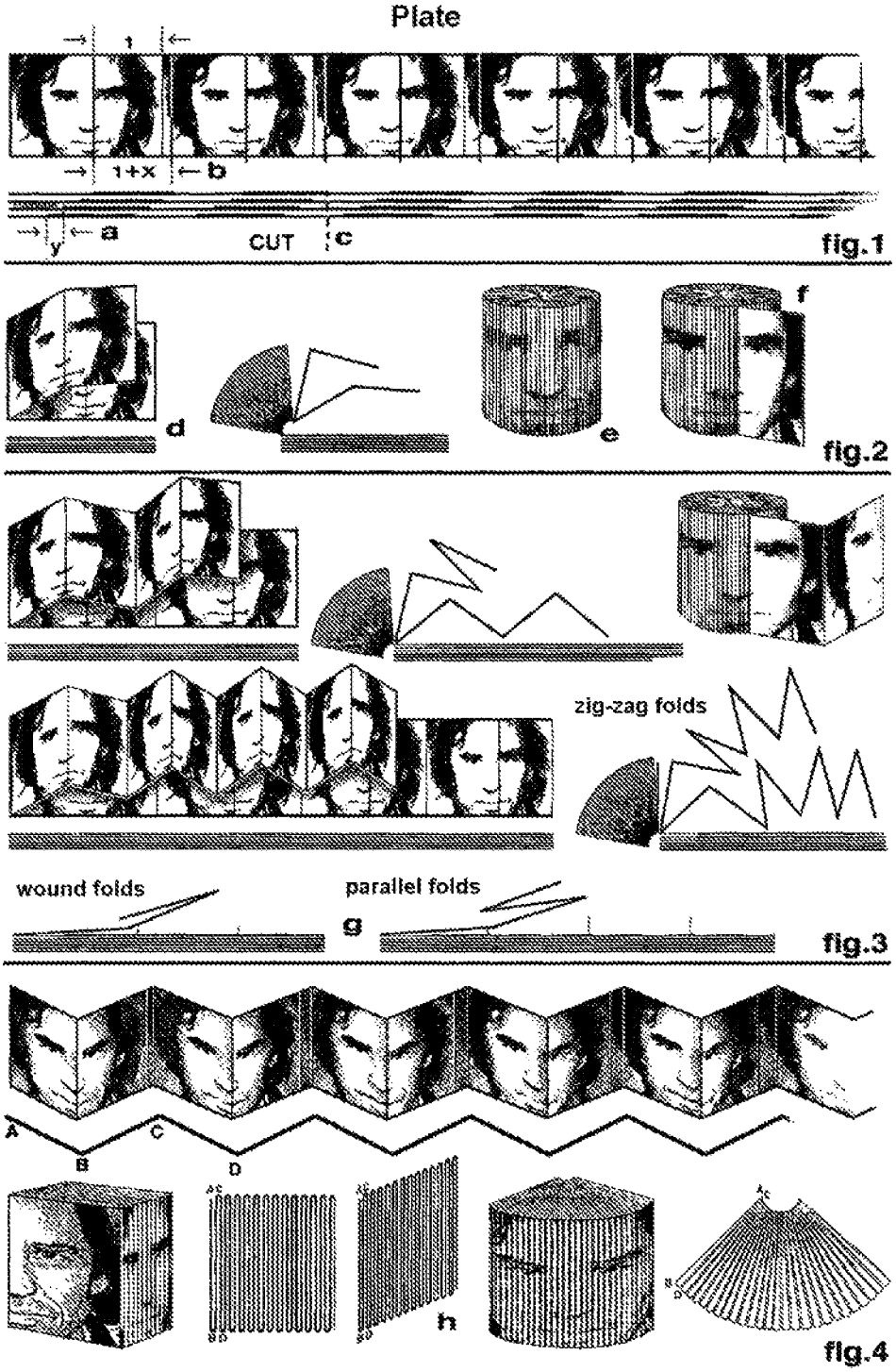
FIGS. 1*a-c* is an exemplary embodiment of the present invention.
FIGS. 2*d-f* is an exemplary embodiment of the present invention.
FIG. 3*g* is an exemplary embodiment of the present invention.
FIG. 4*h* is an exemplary embodiment of the present invention.
Figure 5:
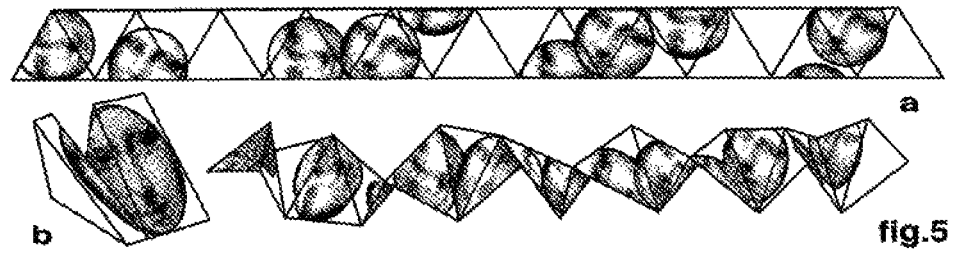
FIGS. 5*a-b* is an exemplary embodiment of the present invention.

In the manufacturing of objects from a single sheet comprising a scoring operation with parallel lines and a zig-zag folding operation, the original design is reconstituted in successive strips on the lateral surfaces of the object (FIG. 4). In the manufacturing of objects from a single sheet comprising reproduction, scoring and folding operations, relative to successive lines that are not parallel, for example at alternating angles of 60° (FIG. 5*a*), the result is, for example, triangular books with designs reconstituted on the three lateral sides (FIG. 5*b*) and which can be opened in three directions.

Figure 12:
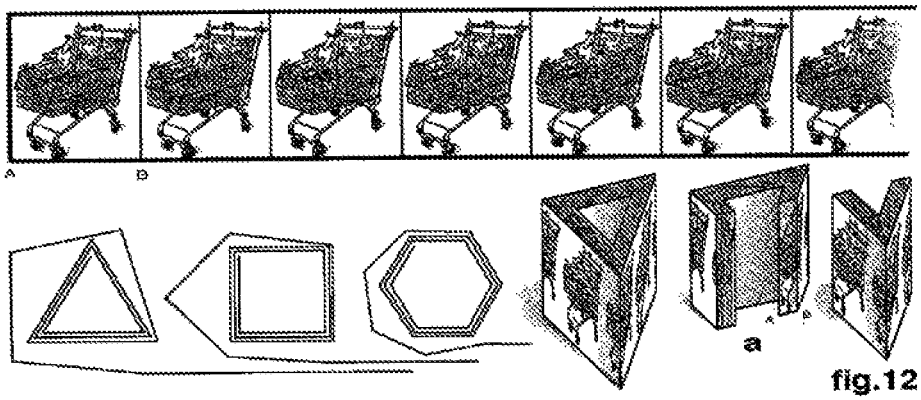
FIG. 12*a* is an exemplary embodiment of the present invention.
Figure 13:
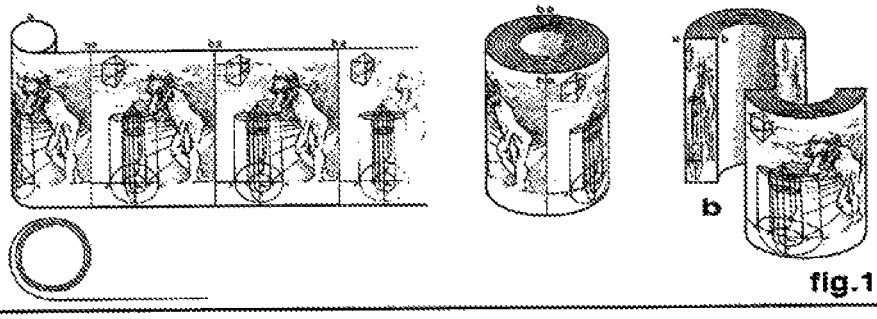
FIG. 13*b* is an exemplary embodiment of the present invention.
Figure 14:
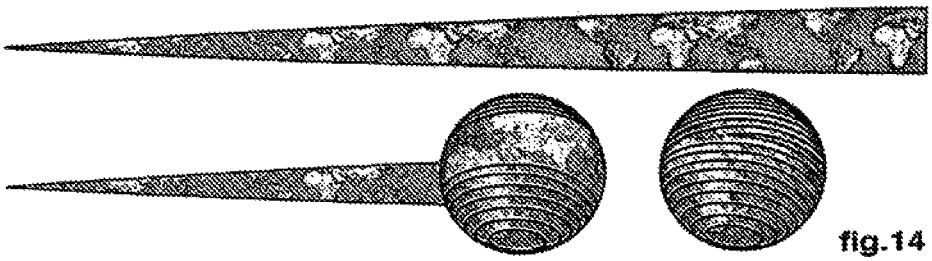
FIG. 14 is an exemplary embodiment of the present invention.
Figure 15:
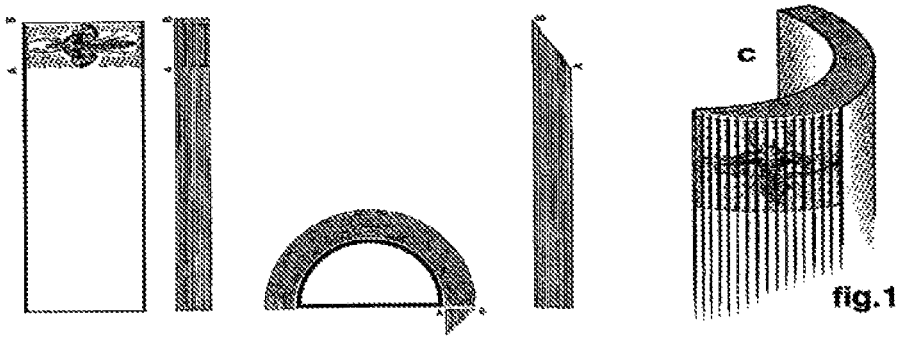
FIG. 15*c* is an exemplary embodiment of the present invention.

The sheet folding operation can be performed at angles other than 180° and with differences between the folds increasingly smaller to a zero value, for example 120°, 90° and 60° (FIG. 12), and in each case, the fold is produced in the same direction, with the space between the folds and the curvature of the fold increased relative to the preceding ones with values proportional to the thickness of the sheets. This results in volumes in the form of triangular, square, hexagonal, octagonal, etc. prisms, to a cylindrical form (FIG. 13). In these volumes, each design is offset relative to the design below by a difference proportional to the thickness of the paper and its volumes, once cut, show, in the edge surfaces of the sheets, the reconstituted designs (FIGS. 12*a* and 13*b*), or, in the case of a reduction of the width of the sheets by topometric precutting, the design is reconstituted on the edge of the volume (FIG. 14). The places of the folding can be determined by a scoring, a perforation, indicated by markers or quite simply determined by the dimensions or the forms of the sheet or sheets to be folded.

In this method, it is possible to use sheets of various materials and of various thicknesses, laminated or woven, rigid or flexible, opaque or transparent, for example paper, cardboard, plastic, metal or textile. The folding operations can be performed cold or hot.

The method also matches with French or Chinese assembly operations (FIG. 24*c*), for example spiral-bound, glued, stitched, stapled, and cutting operations, for example laser, hole-punching, trimming, before or after the folding operations, applied to the block of sheets or sheet by sheet. The cutting operations can be performed with one and the same form, or with different forms.

Figure 23:
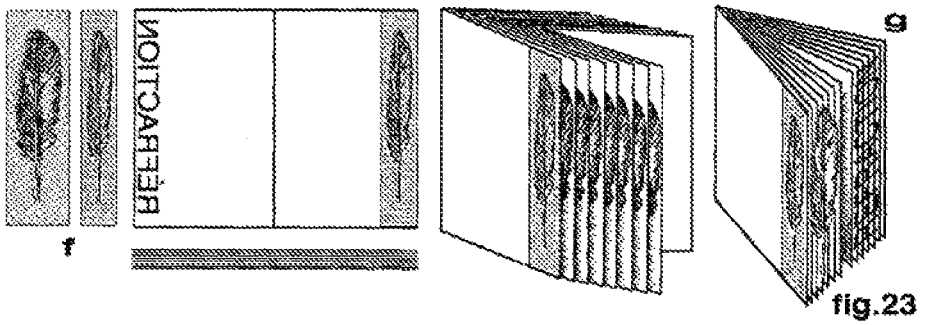
FIGS. 23*f-g* is an exemplary embodiment of the present invention.

The novel method can be adapted to multiple industrial manufacturing procedures, with edge surfaces of designs placed at the levels provided for the folding or cutting by an imposition operation in the folios, a method that consists in distributing the pages and in placing them correctly on the form; in order, ultimately, once the sheet has been folded and the notebooks placed together, for the design to be reconstituted on the folds, the cellular parts or the edge surfaces of objects. It is also possible to adapt the method to the manufacturing procedure, for example notebooks, by the positioning of the design, possibly compressed (FIG. 23*f*), at the place provided for the trimming after the operation of folding of the blocks of sheets, in order for the designs to be reconstituted by successive strips in the edge surface of the notebooks (FIG. 23*g*).

The volume of books deriving from this method can be rectangular, circular or just in circular arc form, or equally in different forms for example (on a base that is) triangular, hexagonal, or star-shaped (FIG. 8*h*), which can be opened on one or more sides.

Figure 8:
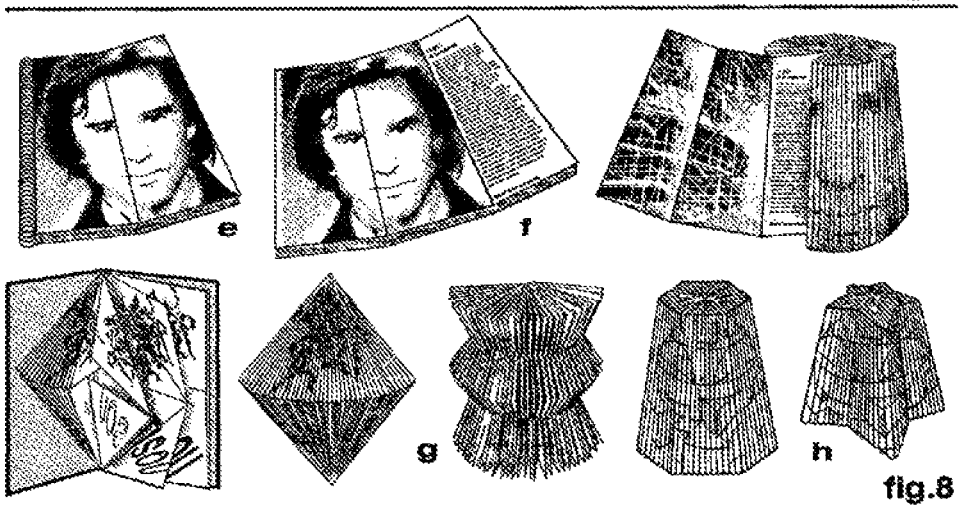
FIGS. 8*e-h* is an exemplary embodiment of the present invention.
Figures 16, 17, 18, 19, 20:
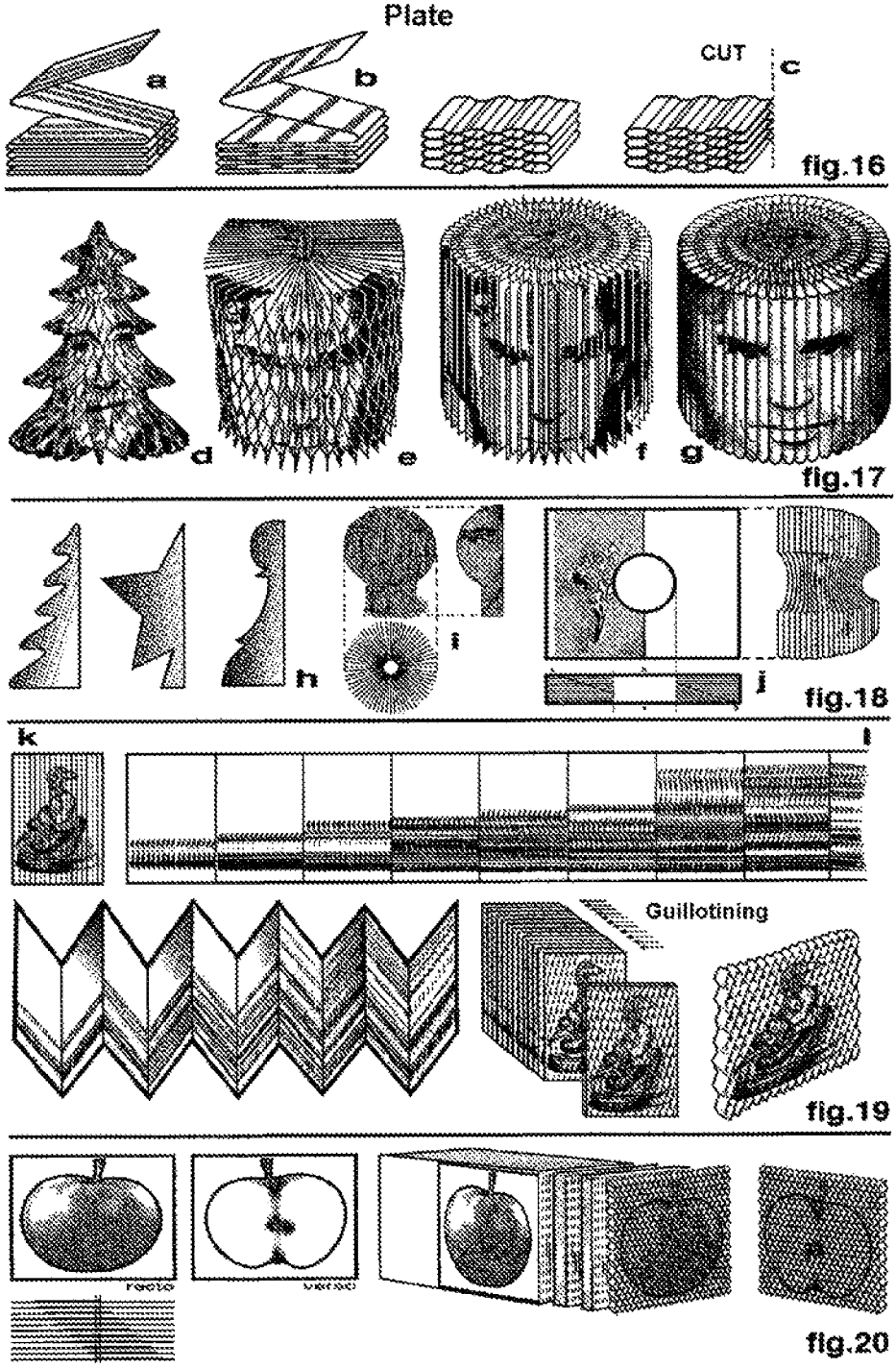
FIG. 19 is an exemplary embodiment of the present invention.
FIG. 20 is an exemplary embodiment of the present invention.

On opening any sheet of a circular book, in its first form (FIG. 2), deriving from this method, according to the direction of the offsets of the designs, it is possible to restore the part of the corresponding design in the continuity of the overall design (FIG. 20. In the same context, the regular, simple or combined folding at any level of sheets, reveals the original design (FIG. 8*g*).

The sheets can be secured by gluing, so as to obtain cellular blocks of honeycomb type. The operation consists in depositing, before the folding, lines of glue offset relative to one another from one sheet to another, or from one flap to the other, of the same sheet. The lines of glue can be deposited parallel to the fold (FIG. 16*b*), making it possible to reconstitute the design on the pleats of the object (FIG. 17*g*) and, after an optional trimming operation, also parallel to the fold (FIG. 16*c*), restore the reconstituted design in the longitudinal cells (FIG. 170, or at right angles to the fold (FIG. 16*a*) in the case of production, for example, of cellular slices (FIGS. 19 and 20).

The patterns are shifted, for example, in a horizontal or vertical direction (FIG. 24*b*), depending on whether the aim is to have them revealed in the honeycomb-type cellular parts (FIGS. 17*d* and 17*e*), or on the folds (FIG. 17*g*). The cellular slices (FIG. 20) make it possible to read recto and verso prints from a different viewpoint.

Figure 27:
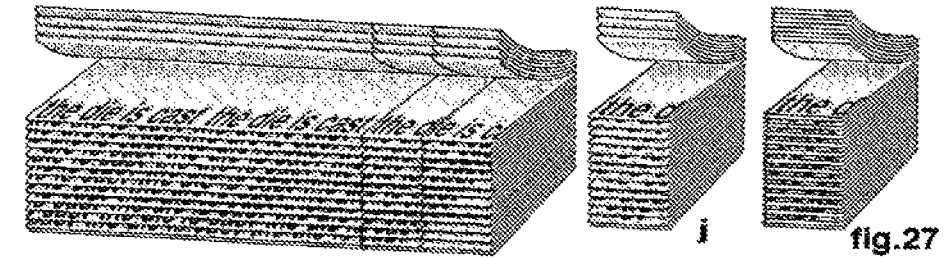
FIG. 27*j* is an exemplary embodiment of the present invention.

The preparation of the designs is adapted to the design of the object, for example by a series of strips (FIG. 19*l*) corresponding to slices of a cut image (FIG. 19*k*). The separations of blocks, or any other cutting-based finishing operation, can also be performed slantwise (FIG. 24*d*) in order to better reveal the images in the slices. The method makes it possible to produce animations generated by the offsetting of animated designs or texts by leafing through the pages (FIG. 27). The same object can have a number of folding possibilities allowing for transformations by form or by artwork. It is also possible to design objects in photographic paper corresponding to all these proposals and particularly in origami where the reproduction is produced after the folding by photographic methods.

It is possible to adapt the method to the computing world and create fixed or animated virtual images reflecting the manufacturing procedure through existing 3D software, or by creating suitable new software.

This industrial method is based on the idea of a geometrical space with memory, with different parameters relative to the metric values of the objects and which, in printing, finds the ideal universe for its experimentation. The image reproduced on superposed sheets appears as projected (extrudes) and fixed in the mass of sheets.

Concerning this spatial volume, it can be imagined that each of these parallel planes stores all the volumetric and chromatic values of an object which passes through it and that the offsetting of these imprints from one plane to another contains a space-time value which reveals the direction of the motion.

In the will to return to the origin of the constructions of forms and of volumes from a point, from a line or from a plane, the mathematical nature with memory of this mass allows for experimental manipulations and, through spatial fractures, projects the original object into another space, that of a parallel reality.

The substance that printing provides, once sliced or folded intelligently, reveals the original image and forms in volume refractions, reflections and anamorphoses, and the objects deriving from this method make it possible to become accustomed to a novel mathematical vision.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A method for manufacturing a cylindrical object from at least one sheet that is folded, wherein the cylindrical object includes at least one design reconstituted at a plurality of edges of folds of the at least one sheet, comprising:

reproducing the at least one design on a front or back of the at least one sheet, in a repeated manner or to follow one another in at least one direction on one or more of the at least one sheet, the at least one design being systematically shifted relative to one another, the at least one sheet including a plurality of scorings produced at regular intervals and progressively shifted relative to the at least one design;

cutting the at least one sheet; and folding the at least one sheet along the plurality of scorings to create, on a lateral surface of the cylindrical object, the at least one design via display of successive strips of the at least one design, the successive strips corresponding to the plurality of scorings located next to each other via the folding, wherein the reproducing the at least one design includes reproducing strips of the at least one design at positions corresponding to the plurality of scorings.

2. The manufacturing method of claim 1, further comprising:

cutting a total or partial volume of the at least one sheet at least one of the group consisting of a right angle relative to planes of the at least one sheet and an oblique angle, allowing a portion of the at least one design to be displayed on edges of the at least one sheet.

3. The manufacturing method of claim 1, further comprising:

cutting along one or more of the scorings or along an edge of the at least one sheet repetitively with a same or different form.

4. The manufacturing method of claim 1, further comprising:

grooving and folding the at least one sheet in two directions systematically offset relative to the at least one design on the at least one sheet for producing an object that contracts with patterns that are reconstituted on pleats formed by the grooving and the folding.

5. The manufacturing method of claim 1, further comprising:

securing the at least one sheet by depositing an adhesive offset relative to one another from a first of the at least one sheet to another of the at least one sheets or from a first flap to another flap of the same of the at least one sheet folded, wherein the adhesive is parallel to the scorings of the sheets.

6. The manufacturing method of claim 1, further comprising:

trimming the at least one sheet at a right angle to the at least one sheet so that an edge surface of the trimmed portion of the at least one sheet includes part of the at least one design; and folding each of the at least one sheet to form a plurality of pleats, the folding reconstituting, on the edges of the plurality of pleats, at least a portion of the at least one design.

7. The manufacturing method of claim 1, wherein the cylindrical object is a three dimensional image of the at least one design.

* * * * *